United States Patent [19]

Kosmatka

[11] 4,006,377

[45] Feb. 1, 1977

[54] FILTER ATTACHMENT FOR PARABOLIC REFLECTOR LAMPS

[75] Inventor: Walter J. Kosmatka, Niles, Ohio

[73] Assignee: General Electric Company, Schenectady, N.Y.

[22] Filed: Jan. 12, 1976

[21] Appl. No.: 648,287

[52] U.S. Cl. ..... 313/112; 240/46.57; 240/46.59; 350/318

[51] Int. Cl.[2] ..... H01K 1/26

[58] Field of Search ..... 313/110–112, 313/116; 240/41 SB, 41 SC, 41.3, 41.4 R, 41.4 D, 46.59, 46.57, 9.5; 350/311, 318

[56] References Cited

UNITED STATES PATENTS

| | | | |
|---|---|---|---|
| 2,440,103 | 4/1948 | Land | 240/9.5 |
| 2,830,002 | 4/1958 | Mohs | 313/112 X |
| 3,191,025 | 6/1965 | Harker | 350/318 X |
| 3,731,080 | 5/1973 | Eloranta | 240/9.5 |

*Primary Examiner*—Siegfried H. Grimm
*Attorney, Agent, or Firm*—Paul F. Wille; L. R. Kempton; Frank L. Neuhauser

[57] ABSTRACT

Filters, in the form of lens covers, are provided for PAR lamps and attached to the outside thereof by means of a ring of heat-shrinkable tubing which both fastens and seals the filter to the lamp.

6 Claims, 2 Drawing Figures

FILTER ATTACHMENT FOR PARABOLIC REFLECTOR LAMPS

BACKGROUND OF THE INVENTION

This invention relates to PAR (parabolic aluminized reflector) lamps and, in particular, to means for attaching a filter over the lens of such lamps.

In the prior art, a variety of proposals have been made for providing a filter for a PAR lamp. Typically, the filter is a color filter, although other filters have been used in the prior art and can be used in the present invention.

One type of color filter utilizes a stained or dyed lens, made for example by ion implanting copper in the outer surface of the lens. However, staining the glass lens is a difficult process to control. Also, as the light transmission of the filter is increased, the color is generally degraded and vice versa. When governmental limits on wattage are added to the problem, the result is that only a small percentage of some lamp types meet all SAE (Society of Automotive Engineers) specifications for color and photometry. Alternatively, internal glass filters are costly and difficult to assemble into the lamp.

Prior art attempts at solving the problem include coating the lens with a transparent plastic and using a separate plastic filter, fluted or unfluted, in front of the lens. While the former approach provides an integral package, there are problems with variations in coating thickness. Also, solvents and spraying and drying equipment are required. With the latter approach, customer costs are higher and there may be increased transmission loss due to dirt on the inner surface of the filter. Also, at present, some state vehicle codes prohibit this type of construction.

SUMMARY OF THE INVENTION

In view of the foregoing, it is therefore an object of the present invention to provide an improved filtered PAR lamp.

Another object of the present invention is to provide a mechanically joined filter and PAR lamp having a dirt and moisture tight seal between the lamp and the filter.

A further object of the present invention is a new method for assembling a PAR lamp.

The foregoing objects are achieved in the present invention wherein a soft glass or thermoplastic filter is attached to a PAR lamp with a section of heat-shrinkable tubing.

BRIEF DESCRIPTION OF THE DRAWING

A more complete understanding of the present invention can be otained by considering the following detailed description in conjunction with the accompanying drawing, in which.

DESCRIPTION OF THE PREFERRED EMBODIMENT

Figure 1:
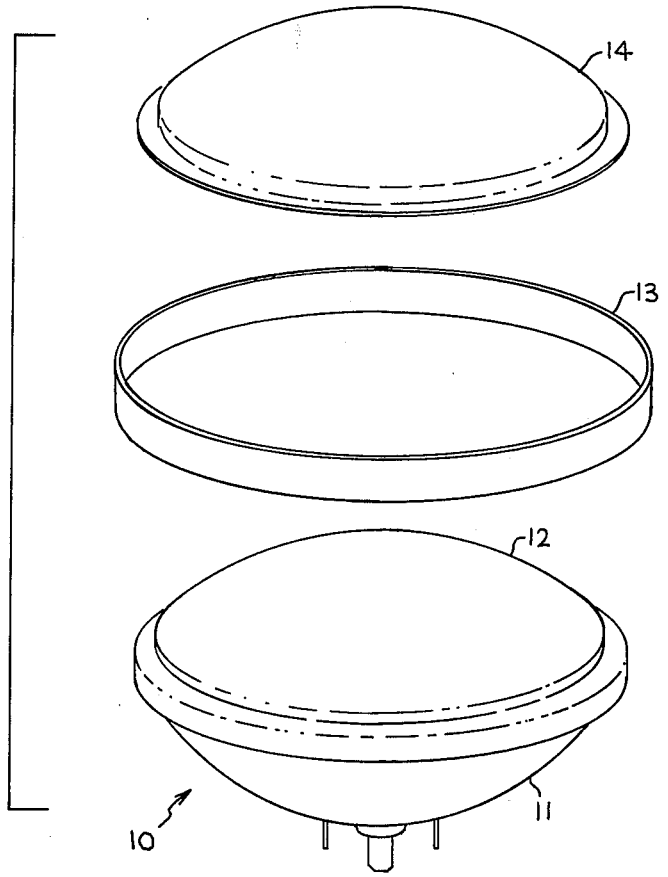
FIG. 1 illustrates an exploded view of a preferred embodiment of the present invention.

As illustrated in FIG. 1, a sealed beam lamp 10 comprising reflector 11 and lens 12 has a filter 14 covering the lens and attached to lamp 10 by way of a section of heat-shrinkable tubing 13. Specifically, lamp 10, which may comprise a headlamp or other sealed beam lamp, is provided with a fluted or unfluted lens 12, which is sealed thereto by any suitable means known in the art. Filter 14, which may comprise soft glass or thermoplastic material, such as "Lexan" plastic as sold by General Electric Company, is stained to the desired color by any suitable means known in the art. The filter is attached to the lamp by way of heat-shrinkable tubing 13, which provides a moisture and dust tight seal, in addition to mechanically attaching the filter to the lamp. Tubing 13 preferably comprises heat-shrinkable tubing, such as "Thermofax" as sold by 3M Inc. This tubing is available in a variety of diameters and has the characteristic of "relaxing" to 70% or 80% of its original size upon the application of heat.

The filtered lamp is assembled by positioning filter 14 over lens 12 and tubing 13 about the major diameter of the lamp. Heating the tubing, for example by way of a heat lamp, causes it to constrict and form a mechanical seal around the lamp rim and periphery of the filter.

Figure 2:
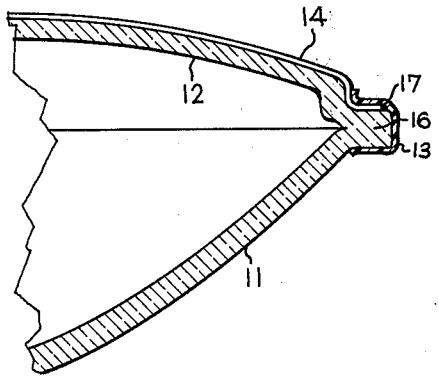
FIG. 2 illustrates, in cross section, a filter and lamp assembled in accordance with the present invention.

FIG. 2 illustrates in cross section a detail of the seal formed by the heat-shrinkable tubing. Specifically, the axial length of the tubing, i.e., the height of the tubing as illustrated in FIG. 1, exceeds the thickness of rim 16 of lamp 10 and lip 17 of filter 14 so that the tubing wraps about both upon shrinking to form a labyrinth seal through which it is difficult for dirt and moisture to pass.

It is understood that in the sense of the present invention, the term "seal" does not mean a moisture or gas impervious seal as used to describe the seal between lens 12 and reflector 11. In other words, the labyrinth seal formed by tubing 13 is impervious to macroscopic moisture and dirt; whereas the seal between the lens and reflector of the sealed beam lamp is impervious to microscopic and submicroscopic particles of moisture and dirt.

There is thus provided by the present invention a new, filtered sealed beam lamp and method of assembly in which the filter is mechanically attached to the lamp by a labyrinth seal against dirt and moisture. In addition, the color and transmission properties of the filter are more easily controlled than those of a stained glass lens, and the appearance of the lamp is more uniform than either stained glass or sprayed plastic coatings.

Having thus described the invention, it will be apparent to those of ordinary skill in the art that various modifications can be made within the spirit and scope of the present invention. For example, while sealed beam headlamps are the only type presently allowed on vehicles in the United States, it will be apparent to those of ordinary skill in the art that the heat-shrinkable tubing may be used to assemble lamps having an inner bulb; for example, having a sealed, quartz-halogen lamp positioned within the reflector of lamp 10. Thus, the need for a gas/moisture tight seal (in the microscopic sense) between the lens and reflector is obviated, and the lamp parts can be readily assembled and mechanically connected by way of the heat-shrinkable tubing. In addition, in this alternative construction, plastic lamp elements may be utilized instead of the glass reflector and lens as illustrated in FIG. 2. Also, adhesive may be used on the tubing or filter to facilitate assembly of the filter lamp.

What I claim as new and desire to secure by Letters Patent of the United States is:

1. A beam projection lamp comprising:

a concave reflector having a rim about the open end thereof;

filament means within said reflector for producing light;

a lens having the periphery thereof engaging the rim of said reflector;

filter means for selective light transmission positioned on the opposite side of said lens from said reflector; and fastening means, comprising a section of heat-shrinkable plastic tubing conforming to the peripheries of said lens and filter means and to said rim, for mechanically attaching and sealing said filter means to said lens and reflector.

2. The lamp as set forth in claim 1 wherein said reflector, filament means, and lens comprise a sealed beam lamp.

3. The lamp as set forth in claim 2 wherein said filter means comprises a color filter.

4. The lamp as set forth in claim 3 wherein said color filter comprises thermoplastic material.

5. The lamp as set forth in claim 4 wherein the axial height of said tubular section exceeds the thicknesses of said peripheries and rim to form a labyrinth seal therewith.

6. The method of assembling a filtered sealed beam lamp comprising the steps of:

positioning an optical filter over the lens of a sealed beam lamp;

positioning a tubular section of heat-shrinkable plastic about the major diameter of said lamp and filter; and heating said plastic to cause it to decrease in diameter to mechanically fasten and seal said filter to said lamp.

* * * * *